United States Patent [19]

Bollen

[11] Patent Number: 4,976,018

[45] Date of Patent: Dec. 11, 1990

[54] DEVICE FOR MONITORING THREADS ON A TEXTILE MACHINE

[75] Inventor: Manfred Bollen, Oberuzwil, Switzerland

[73] Assignee: Benninger AG, Uzwil, Switzerland

[21] Appl. No.: 419,712

[22] Filed: Oct. 11, 1989

[30] Foreign Application Priority Data

Oct. 19, 1988 [CH] Switzerland ..... 3891/88

[51] Int. Cl.[5] ..... B65H 63/02; D02H 13/06; D01H 13/16

[52] U.S. Cl. ..... 28/187; 57/80; 57/81; 57/86; 57/264; 66/211; 139/354

[58] Field of Search ..... 28/187; 57/80, 81, 86, 57/264; 66/211; 139/354

[56] References Cited

U.S. PATENT DOCUMENTS

| | | | |
|---|---|---|---|
| 3,818,236 | 6/1974 | Lind et al. | 28/187 X |
| 3,892,492 | 7/1975 | Eichenberger | 139/273 X |
| 4,100,425 | 7/1978 | Ohsawa | 28/187 X |
| 4,407,767 | 10/1983 | Seaborn | 28/187 X |
| 4,444,132 | 4/1984 | Breitenbach | 28/187 X |

FOREIGN PATENT DOCUMENTS

| | | |
|---|---|---|
| 2915749 | 2/1982 | Fed. Rep. of Germany . |
| 417491 | 2/1967 | Switzerland . |
| 553270 | 8/1974 | Switzerland . |

*Primary Examiner*—Werner H. Schroeder
*Assistant Examiner*—Bradley Kurtz DeSandro
*Attorney, Agent, or Firm*—Shoemaker and Mattare, Ltd.

[57] ABSTRACT

A monitoring needle (19) is rotatably mounted under spring tension in a housing (18). A light emitter/light receptor device is fixed to the housing (18) in the plane of the thread (5) and in the pivotal region of the monitoring needle (19), this device producing a control signal both in the case of irregularity in the thread and when crossed by the monitoring needle.

11 Claims, 3 Drawing Sheets

DEVICE FOR MONITORING THREADS ON A TEXTILE MACHINE

BACKGROUND OF THE INVENTION

The invention relates to a device for monitoring threads on a textile machine by producing a control signal both in the case of an irregularity in the thread and when crossed by a monitoring needle, which is positioned in a housing under spring tension in close proximity to a light-emitting and receiving device in the thread's plane and in the pivotal region of the needle. Such devices are for example mounted on the bobbin creel of a warp system, in order to monitor the presence of threads drawn from the bobbins. If a thread breaks, the winding apparatus is automatically stopped.

A comparable device of this kind is known of example from DE-C-29 15 749 of the Applicant. In this case the control signal is triggered by the closing of electric contacts when the monitoring needle is pivoted. According to another principle, the control signal is triggered when the pivoting monitoring needle interrupts a light beam directed at a photocell. A thread monitor of this kind is known for example from CH-A-417 491 or from U.S. Pat. No. 4,100,425. Most known thread monitors are additionally provided with a device for locking the monitor needle in the operating position so that, in a row of adjacent monitor needles, individual needles can remain unoccupied without triggering a signal.

In many textile machines, in addition to checking the actual presence of the thread, quality control of the individual threads also has to be carried out. To this ends, a group of threads gathered together in one plane is guided through a light beam. If a yarn imperfection, e.g. in the form of a knot or a thread end passes through the light beam, the quantity of light transmitted decreases, whereby according to the sensitivity setting, a control signal for stopping the machine may also be triggered. A comparable principle is known for example from CH-A-553 270. This quality control of the thread is conventionally carried out immediately before the winding drum, as the threads have to be gathered together there in any case.

A disadvantage of the known devices is that the presence monitoring on the one hand and quality control on the other hand have to be executed in different components and at different places. This considerably increases expenditure on equipment and the possibilities of an operating fault. Furthermore, it is necessary to wind the thread round and through so many guides that threading takes up a relatively large amount of time. The large additional diversions of the thread, e.g. for gathering together and re-separating of the threads, furthermore increase the risk of thread breakages. It is therefore an object of the invention to improve a device of the kind cited at the beginning in such a manner that not only presence monitoring but also quality control of the thread can be carried out in a single unit. This object is achieved according to the invention with a device having the features of claim 1.

SUMMARY OF THE INVENTION

The light beam in this case not only passes through the oscillating range of the monitoring needle, but also through the plane of the thread itself, so that it fulfils a double function. The control signal is triggered and the apparatus is halted both by irregularities in the thread or changes in position of the thread. Thus only a single switching circuit is required to operate the light emitting/light receiving device. The distance between the bobbin creel and the winding machine may be reduced, since quality control can be carried out directly at the bobbin creel.

Further individual features and advantages of the invention will appear from the following description and drawings, in which:

DESCRIPTION OF THE PREFERRED EMBODIMENTS

Figure 1:
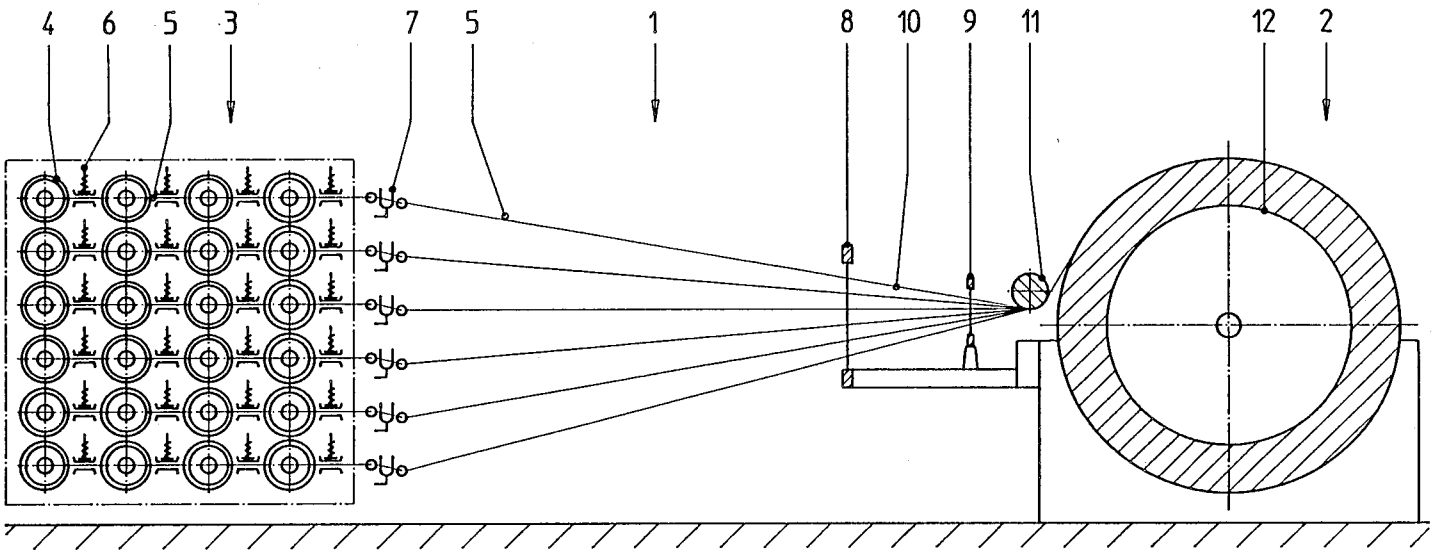
FIG. 1 is a side view of a winding device, much simplified.

In FIG. 1, a winding device 1 such as e.g. a warp system is shown in a side view. It consists of a winding machine 2 and a bobbin creel 3.

On the bobbin creel 3, bobbins 4 are mounted whose threads 5 pass through a respective thread tension device 6 for generating the desired thread tension. Then each thread passes through a thread monitor 7 according to the invention, in which a presence check and/or quality control is carried out. The thread monitors 7 are grouped together in rows, as will be explained in more detail below.

As they leave the bobbin creel 3, the threads directly reach the cross reed 8, in which the threads 5 obtain a particular position, then to be fed to the warp reed 9 as a thread cluster 10 in order to receive its warp tape width. The tapes are wound on to the warp drum 12 via deflection pulleys 11 in a known manner. If one of the threads guided through the thread monitors 7 breaks, a control signal is produced, which immediately stops the winding machine 2. The same happens if a thread has an irregularity, e.g. a thread end, a spinning flaw or a knot. Simultaneously with the stopping of the machine, an optical signal may be triggered to indicate to the operator the position of the flaw.

Figure 2:
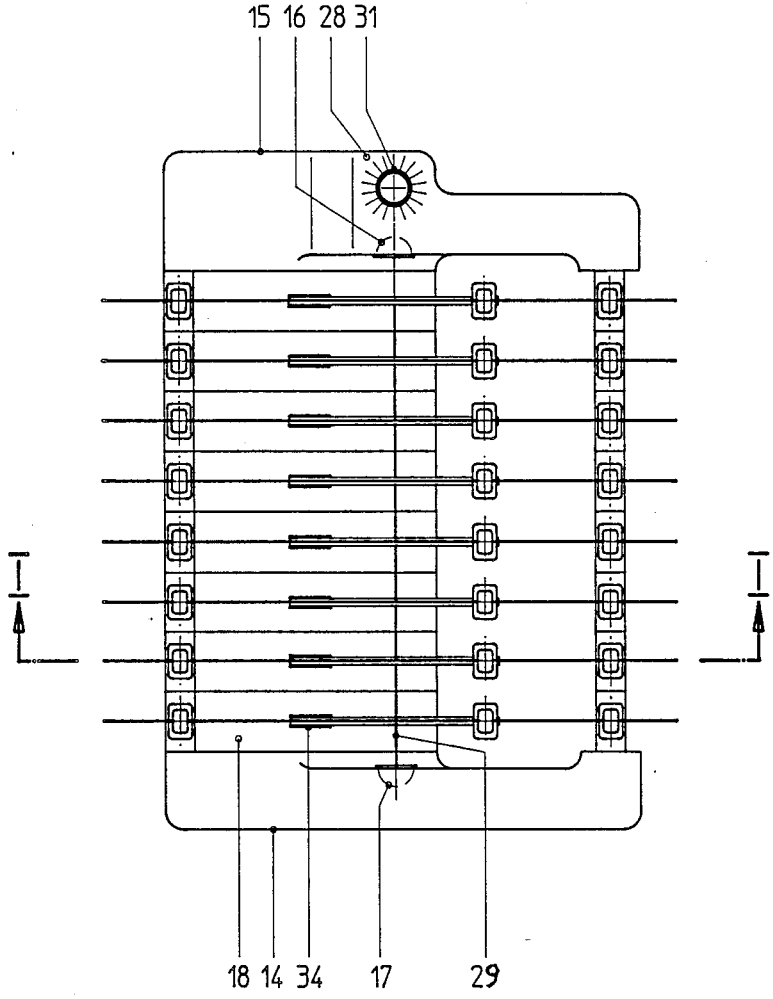
FIG. 2 is a plan view of a device according to the invention with a plurality of monitoring needles.
Figure 3:
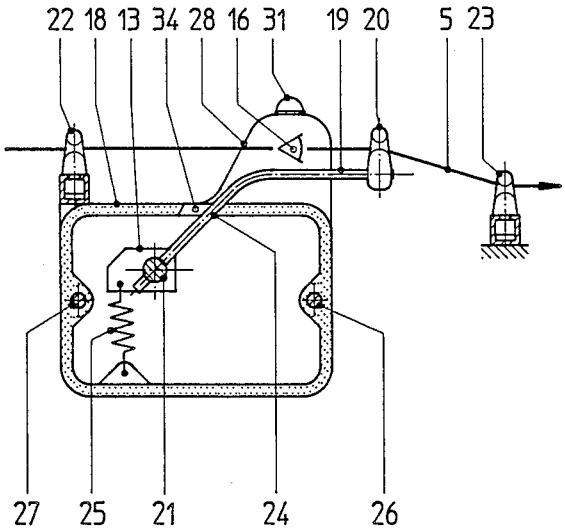
FIG. 3 is a cross-section through the plane I—I according to FIG. 2.

The construction of the device according to the invention can be seen more precisely from FIGS. 2 and 3. A plurality of housing sections 18 are held together by threaded rods 26, 27. In each individual housing section, a monitoring needle 19 is pivotably mounted on a shaft 21, which extends approximately at right angles to the direction of the thread. The monitoring needles 19 are bent parallel to the thread and their free ends project through a slot 34 in the housing section. A thread sensor 20 is disposed at the end of each monitoring needle and may be pressed against the thread 5. Alternatively, the monitoring needles may, however, be mounted in a one-piece housing.

Figure 6:
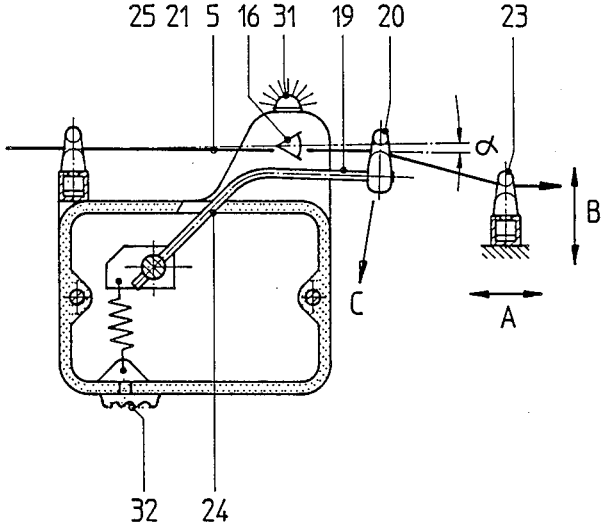
FIG. 6 shows the device according to FIG. 3 in the case of an excessive thread tension.

Each shaft 21 is connected to a lever arm 13, on whose end a draw spring 25 for generating a spring tension is fixed. The draw spring 25 may either be fixed to the inside wall of the housing or may, as illustrated in FIG. 6 for example, be engaged in a notch 32 on the exterior of the housing, so that the spring tension is adjustable. Instead of the notch 32, the spring tension could also be adjusted e.g. by an adjusting screw or the like.

Each thread 5 is guided on the housing section 18 by a fixed thread guide 22 and behind the housing section by an adjustable thread guide 23. The adjustable thread guide 23 is in this case so arranged that the thread is slightly bent back after passing through the thread sensor 20. The spring tension of the monitoring needle 19 is so adjusted that in the operating position the monitoring needle is pressed against a stop 24. This stop is formed by a section of the slot 34. In the operating position the thread 5 runs approximately parallel to the upper side of the housing section 18.

The housing sections 18 are sealed laterally by end sections 14 and 15. Each of these end sections carries a raised housing section 28, which projects above the upper side of the housing sections 18. On this raised housing section, a light emitter 17 is mounted on the end section 14 and a light receptor 16 on the end section 15. The light emitter 17 is directed at the light receptor 16 and emits a light beam 29. This light beam 29 runs in the plane of the taut threads 5 in the operating position of the monitoring needles 19 and simultaneously in the oscillating range of the monitoring needles 19. A signal lamp 31 is also mounted on the end section 15, and lights up when the machine stops. Both end sections 14, 15 carry the adjustable thread guide 23 on a bracket. The thread guide 23 is adjustable in the brackets by means not shown in more detail.

Figure 5:
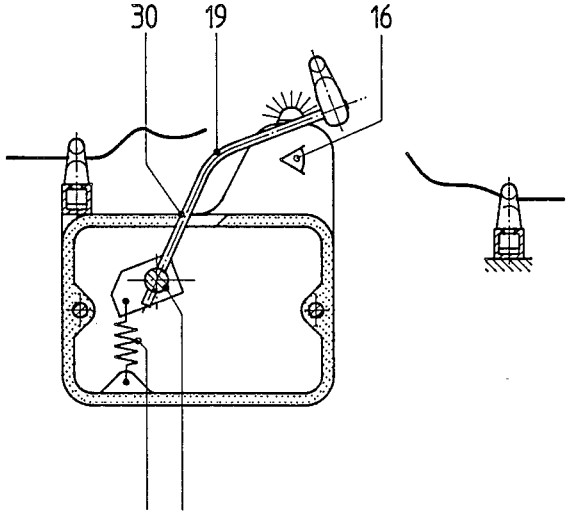
FIG. 5 shows the device according to FIG. 3 during a thread breakage.

In the absence of taut threads 5, the monitoring needle 19 is pivoted from the operating position illustrated in FIG. 3 by means of the spring 25 into an alarm position, which is illustrated in FIG. 5. In the alarm position the monitoring needle 19 rests on the stop 30, which is also formed by a section of the slot 34. Obviously, these stops could also be formed by adjustable components, so that the relative position of the monitoring needle can be adjusted in the operating position or alarm position.

Figure 4:
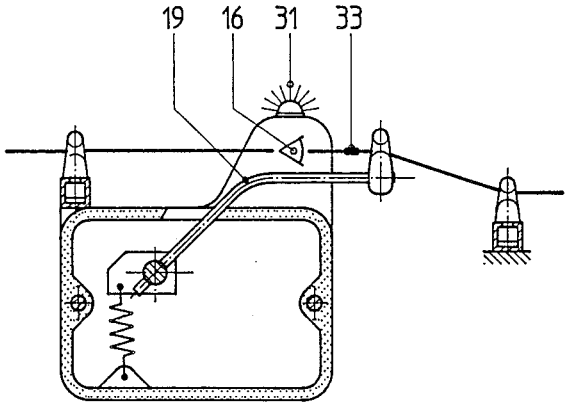
FIG. 4 shows the device according to FIG. 3 during the passage of an irregularity in the thread.

The function of the device in the case of an irregularity in a thread can be seen in FIGS. 4 to 6. In FIG. 4, a thread end or knot 33 has passed the light beam 29, so that the light receptor 16 reads a reduced light intensity. This deviation is sufficient to trigger a control signal; whereby the winding apparatus can be stopped. The difference in light intensity can in this case be a measure of the size of the fault, so that the measuring and control device can be adjusted in such a manner that, in the case of slight faults, no control signal is triggered. As can be seen from FIG. 4, the position of the monitoring needle 19 does not change when an irregularity in the thread is detected.

FIG. 5 shows the breakage of a thread 5, in which case the monitoring needle 19 pivots into alarm position and thus crosses the light beam 29. The stop 30 may also be mounted in such a manner that the light beam 29 is not only crossed in the alarm position, but is completely interrupted. To this end, a flag or screen could additionally be mounted on the monitoring needle 19. The photocell or light receptor 16 registers the temporary or optionally permanent interruption of the light beam and in this manner also puts the winding machine out of operation. The same occurs when the thread merely slackens, without resulting in actual breakage of the thread. As soon as the thread tension falls unacceptably low, the monitoring needle also passes within the range of the light beam 29 and thus triggers the control signal to stop the device.

The stop 30 is preferably so mounted that the monitoring needle, without a thread, crosses the light beam completely and lies in the alarm position outside the light beam. Thus individual monitoring needles may remain unoccupied without the necessity to stop the machine. The device is functional both in the alarm position and in the operating position.

A further function of the device according to the invention is shown in FIG. 6. According to this, a control signal may also be triggered if the thread becomes too tight. If the tread 5 becomes unacceptably tight, the monitoring needle 19 is subject to a lever effect under the effect of the resulting load C. This causes the monitoring needle 19 to spring back somewhat, so that the thread position is displaced by the angle alpha. This thread displacement may also be registered by the light receptor 16. Obviously, for this function, the monitoring needle must have a rather resilient construction. The turning round or deflection of the thread can be changed by adjusting the adjustable thread guide 23 either in the direction of the arrow A, i.e. in the direction of the thread 5, or in the direction of the arrow B in the pivotal plane of the monitoring needle 19.

In addition to the stopping of the winding machine, an easily visible signal lamp 31 can be actuated, so that the operator(s) can immediately locate the plane of the fault. A pivotable monitoring needle 19 with sprung mounting is held in an operating position by the thread 5. In the thread plane, a light beam 29 is directed from a light emitter 17 to a light receptor 16. If the light intensity deviates from a pre-determined rated value, a control signal is triggered, by means of which the apparatus can be stopped. The control signal is triggered both by a thread irregularity and by any pivoting of the monitoring needle 19. Additionally, mere changes in position of the thread can cause a control signal to be triggered.

I claim:

1. A device for monitoring threads on a textile machine, in particular a warp system, with a monitoring needle (19) which rests on the thread (5) in the operating position, is mounted on a shaft (21) running transverse to the thread direction, and is pivotable in the case of a thread breakage from the operating position to an alarm position, in which case a control signal is triggered, characterised in that on one side of the thread path is mounted a light receptor (16) and on the other side a light emitter (17) directed at the receptor, and in that the light beam (29) emissible by the light emitter runs through the plane of the thread and through the pivotal range of the monitoring needle (19) between the operating position and the alarm position, the control signal being capable of being triggered by an irregularity in the thread in the plane of the thread or by the pivotal movement of the monitoring needle (19).

2. A device according to claim 1, characterised in that a plurality of monitoring needles are arranged in a row on a housing consisting of mutually abutting housing section (18), and in that the two end sections (14. 15) of the housing carry the light emitter (17) and the light receptor (16) respectively.

3. A device according to claim 1, characterised in that a plurality of monitoring needles are arranged in a row on a housing formed in one piece, and in that the two end sections of the housing carry the light emitter and the light receptor respectively.

4. A device according to claim 1, 2 or 3, characterised in that each monitoring needle (19) may be pressed against the thread (5) by means of spring tension.

5. A device according to claim 4, characterised in that the spring tension is adjustable.

6. A device according to one of claims 1 to 3, characterised in that the pivotal movement of each monitoring needle may be limited in both directions of movement by a respective stop (24, 30).

7. A device according to one of claims 1 to 3, characterised in that the light intensity of the light emitter (17) is adjustable.

8. A device according to one of claims 1 to 3, characterised in that the monitoring needles are resilient, so that they are flexible in the case of unacceptable thread tension.

9. A device according to one of claims 1 to 3, characterised in that the monitoring needles in the alarm position lie outside the light beam emissible by the light emitter.

10. A device according to one of claims 1 to 3, characterised in that each monitoring needle is associated with an adjustable thread guide (23), by means of which guiding of the threads which have passed the monitoring needle (19) is adjustable.

11. A device according to one of claims 1 to 3, characterised in that the adjustable thread guide (23) is adjustable in the pivotal plane of the monitoring needle (B) in the direction of travel of the thread (A) and transverse to the direction of travel of the thread.

* * * * *